US008761622B2

(12) United States Patent
Murayama

(10) Patent No.: US 8,761,622 B2
(45) Date of Patent: Jun. 24, 2014

(54) IMAGE FORMING APPARATUS AND METHOD FOR CONTROLLING IMAGE FORMING APPARATUS

(75) Inventor: Kentaro Murayama, Kasugai (JP)

(73) Assignee: Brother Kogyo Kabushiki Kaisha, Nagoya-shi, Aichi-ken (JP)

( * ) Notice: Subject to any disclaimer, the term of this patent is extended or adjusted under 35 U.S.C. 154(b) by 105 days.

(21) Appl. No.: 13/333,384

(22) Filed: Dec. 21, 2011

(65) Prior Publication Data

US 2012/0163842 A1 Jun. 28, 2012

(30) Foreign Application Priority Data

Dec. 28, 2010 (JP) ..... 2010-292879
Nov. 9, 2011 (JP) ..... 2011-245028

(51) Int. Cl.
*G03G 15/00* (2006.01)

(52) U.S. Cl.
USPC ..... 399/49

(58) Field of Classification Search
USPC ..... 399/40, 64, 72, 301, 179, 372, 394
See application file for complete search history.

(56) References Cited

U.S. PATENT DOCUMENTS

| | | | | |
|---|---|---|---|---|
| 5,381,167 | A * | 1/1995 | Fujii et al. | 347/116 |
| 6,633,734 | B2 * | 10/2003 | Maebashi et al. | 399/49 |
| 7,546,045 | B2 * | 6/2009 | Noguchi et al. | 399/49 |
| 2006/0140685 | A1 | 6/2006 | Muroi | |
| 2006/0158472 | A1 | 7/2006 | Endo | |
| 2008/0031649 | A1 | 2/2008 | Dan | |
| 2008/0075492 | A1 | 3/2008 | Mestha et al. | |
| 2008/0124114 | A1 | 5/2008 | Yamagata et al. | |
| 2009/0123197 | A1 | 5/2009 | Okumura et al. | |
| 2009/0162110 | A1 | 6/2009 | Murayama | |
| 2009/0220263 | A1 | 9/2009 | Murayama | |
| 2009/0297191 | A1 * | 12/2009 | Hirai et al. | 399/49 |
| 2009/0322819 | A1 | 12/2009 | Hayashi et al. | |
| 2010/0238465 | A1 * | 9/2010 | Kageyama et al. | 358/1.9 |
| 2011/0128559 | A1 | 6/2011 | Yamada | |
| 2012/0163843 | A1 | 6/2012 | Murayama | |
| 2012/0163849 | A1 | 6/2012 | Murayama | |

FOREIGN PATENT DOCUMENTS

| | | | |
|---|---|---|---|
| CN | 1835845 | A | 9/2006 |
| CN | 101430528 | A | 5/2009 |
| CN | 101470378 | A | 7/2009 |
| EP | 2 328 036 | A2 | 6/2011 |

(Continued)

OTHER PUBLICATIONS

European Patent Office, European Search Report for European Patent Application No. 11194278.5, dated Apr. 20, 2012.

(Continued)

*Primary Examiner* — Clayton E Laballe
*Assistant Examiner* — Victor Verbitsky
(74) *Attorney, Agent, or Firm* — Baker Botts L.L.P.

(57) ABSTRACT

An image forming apparatus may include a conveyor member, an optical sensor, a drive portion, and a controller. The drive portion performs a rotation for detection to rotate the conveyor member for the mark detection and a rotation for nondetection to rotate the conveyor member for a purpose other than the mark detection. The controller obtains an amount of reflected light received by the optical sensor to determine an adjustment value of sensitivity of the optical sensor based on the amount of received reflected light while the rotation for nondetection is performed. The controller also detects the mark with the sensitivity adjusted based on the determined adjustment value while the rotation for detection is performed.

20 Claims, 9 Drawing Sheets

(56) References Cited

FOREIGN PATENT DOCUMENTS

| | | | | |
|---|---|---|---|---|
| JP | 2004-069909 | A | | 3/2004 |
| JP | 2005-309050 | A | | 11/2005 |
| JP | 2006-178374 | A | | 7/2006 |
| JP | 2008-039905 | A | | 2/2008 |
| JP | 2008-134333 | A | | 6/2008 |
| JP | 2008-158459 | A | | 7/2008 |
| JP | 2009-230119 | A | | 10/2009 |
| JP | 2009230119 | A | * | 10/2009 |

OTHER PUBLICATIONS

Japan Patent Office, Notice of Reasons for Rejection for Japanese Patent Application No. 2011-245028, mailed Mar. 26, 2013.

State Intellectual Property Office of the People's Republic of China, Notification of First Office Action for Chinese Patent Application No. 201110434087.X, mailed Dec. 26, 2013.

* cited by examiner

IMAGE FORMING APPARATUS AND METHOD FOR CONTROLLING IMAGE FORMING APPARATUS

CROSS REFERENCE TO RELATED APPLICATION

This application claims priority from Japanese Patent Application No. 2010-292879, filed on Dec. 28, 2010 and Japanese Patent Application No. 2011-245028, filed on Nov. 9, 2011, which are incorporated herein by reference.

BACKGROUND OF THE INVENTION

1. Field of the Invention

The invention relates to a technique for obtaining an amount of received light reflected from a light-irradiated area of a rotating conveyor member.

2. Description of Related Art

A known image forming apparatus performs a function of correcting positional deviation, e.g., deviation of an image forming position on a sheet. In the image forming apparatus, a pattern, which includes a plurality of marks, e.g., a registration pattern, is formed on a belt, and, while the image forming apparatus irradiates the belt with light, an optical sensor receives light reflected from the belt. The image forming apparatus determines a position of a mark on the belt based on an amount of reflected light received by the optical sensor. In particular, the image forming apparatus determines the position of the mark based on a difference between a reflectance of a surface of the belt and a reflectance of a surface of the mark and determines the difference in the reflectances. Alternatively, the image forming apparatus determines the position of the mark based on amounts of received reflected light and determines a difference between the amount of reflected light received from the surface of the belt and the amount of reflected light received from the surface of the mark. The image forming apparatus corrects the deviation of the image forming position based on the position of the mark on the belt determined from the amount of reflected light received by the optical sensor.

The surface of the belt, however, may become dirty or damaged. The dirt or damage on the surface of the belt may diffuse light reflected off the surface of the belt. This may cause a decrease in the reflectance of the surface of the belt and may prevent the image forming apparatus from determining the position of the mark. To reduce the occurrence of this problem, a known image forming apparatus irradiates a surface of a belt on which a mark is not formed with light, and the image forming apparatus adjusts a sensitivity of an optical sensor based on an amount of reflected light from the belt surface received by the optical sensor.

SUMMARY OF THE INVENTION

Nevertheless, positional variations in the degree of the dirt or damage on the surface of the belt may cause variations in the reflectance of the surface of the belt among different positions along the belt. As a result, the amount of reflected light received by the optical sensor may vary. Consequently, with the above-described structure, the sensitivity of the optical sensor may be adjusted based on the amount of reflected light received at one point in time and at one position along the belt without considering the reflectance variations. Therefore, although the sensitivity of the optical sensor is adjusted, variations in the amount of reflected light among different positions along the belt may cause variations in the accuracy of the position of the mark, which the image forming apparatus determines based on the amount of reflected light received at one point in time and at one position along the belt.

A structure in which the sensitivity of the optical sensor may be adjusted based on the amount of reflected light received at several different points in time while the belt is rotated may reduce variations in the accuracy of the determined position of the mark. Nevertheless, rotating the belt merely to obtain an amount of reflected light received by the optical sensor may waste time and shorten the life of the belt and, ultimately; the life of the image forming apparatus.

An embodiment of the invention provides for a technique for minimizing rotation of a conveyor member only to obtain an amount of reflected light received by an optical sensor.

An image forming apparatus disclosed herein may comprise a conveyor member, an optical sensor, an image forming portion, a drive portion, and a controller. The conveyor member may be configured to rotate. The optical sensor may comprise a light emitting portion configured to emit light toward the conveyor member and a light receiving portion configured to receive reflected light. The image forming portion may be configured to form a print image onto an image recording medium when forming the print image onto the image recording medium and to form a mark onto one or more of the conveyor member and the image recording medium when the optical sensor performs a mark detection. The drive portion may be configured to perform a rotation for detection, wherein the drive portion is configured to rotate the conveyor member for the mark detection and to perform a rotation for nondetection, wherein the drive portion is configured to rotate the conveyor member for a purpose other than the mark detection. The controller may be configured: to obtain an amount of reflected light received by the optical sensor, while the rotation for nondetection is performed; to adjust a value of sensitivity for the optical sensor based on the amount of reflected light received by the optical sensor; and to detect the mark with the sensitivity adjusted optical sensor based on the value while the rotation for detection is performed.

An image forming apparatus disclosed herein may comprise a conveyor member, an optical sensor, an image forming portion, a drive portion, and a controller. The conveyor member may be configured to rotate. The optical sensor may comprise a light emitting portion configured to irradiate the conveyor member with light and a light receiving portion configured to receive reflected light. The image forming portion may be configured to form a print image onto the conveyor member when forming the print image onto the image recording medium and to form a mark for correction onto the conveyor member when the optical sensor performs a mark detection. The drive portion may be configured to perform a rotation for detection, wherein the drive portion is configured to rotate the conveyor member for the mark detection and to perform a rotation for nondetection, wherein the drive portion is configured to rotate the conveyor member for a purpose other than the mark detection. The controller may be configured: to obtain an amount of reflected light received by the optical sensor, while the rotation for nondetection is performed; to adjust a value of sensitivity for the optical sensor based on the amount of reflected light received by the optical sensor; and to detect the mark with the sensitivity adjusted optical sensor based on the value while the rotation for detection is performed.

A method for controlling an image forming apparatus disclosed herein may comprise steps for controlling the image forming apparatus. The image forming apparatus may comprise a conveyor member, an optical sensor, and an image forming portion. The conveyor may be configured to rotate.

The optical sensor may comprise a light emitting portion configured to irradiate the conveyor member with light and a light receiving portion configured to receive light reflected from the conveyor member. The image forming portion may be configured to form a print image onto one or more of the conveyor member and an image recording medium when forming the print image onto the image recording medium and to form a mark for correction onto one or more of the conveyor member and the image recording medium when the optical sensor performs a mark detection. The method may comprise a step of obtaining an amount of reflected light received by the optical sensor and adjusting a value of sensitivity for the optical sensor based on the amount of reflected light received by the optical sensor, while a rotation for nondetection, in which the conveyor member is rotated for a purpose other than the mark detection, is performed. The method may comprise a step of performing a mark detecting process in which the optical sensor detects the mark with the sensitivity adjusted based on the value while a rotation for detection, in which the conveyor member is rotated for the mark detection, is performed.

In the image forming apparatus, the conveyor member may be a medium conveyor member that conveys the image recording medium during printing. The rotation for nondetection may be a rotation of the conveyor member for printing. The controller may perform a conveyance area using process to determine the adjustment value by using an amount of received light reflected from a conveyance area, e.g., the area of the conveying member covered by the image recording medium, that is a part of the conveyor member and holds the image recording medium thereon.

In the image forming apparatus, the controller may perform the conveyance area using process when at least one of criteria is met, and the controller may not perform the conveyance area using process when any of the criteria are not met. The criteria may comprise that a length of the image recording medium in a rotating direction of the conveyor member is greater than or equal to a reference length, and a width of the image recording medium in a direction orthogonal to the rotating direction is greater than or equal to a reference width.

In the image forming apparatus, the adjustment value may be determined based on the amount of reflected light received from the conveyance area and an amount of reflected light received from a nonconveyance area, which is a part of the conveyor member other than the conveyance area, both of which are assigned weights respectively, in the conveyance area using process. More weight may be assigned to the amount of reflected light received from the conveyance area than the amount of reflected light received from the nonconveyance area.

In the image forming apparatus, the adjustment value may be determined based on the amount of received light reflected from the conveyance area only in the conveyance area using process.

In the image forming apparatus, the rotation for nondetection may be a rotation of the conveyor member for printing. The image forming portion may comprise a plurality of image forming units that form images in different colors. The controller may not use the amount of reflected light received by the optical sensor during printing for the determination of the adjustment value when the number of image forming units to be used in printing is greater than or equal to a reference number, and may use the amount of reflected light received by the optical sensor during printing for the determination of the adjustment value when the number of image forming units to be used in printing is less than the reference number.

In the image forming apparatus, the controller may obtain the amount of reflected light received by the optical sensor plural times or for a reference time period. When the controller could not obtain a required amount of received reflected light while the rotation for nondetection is performed, the drive portion may rotate the conveyor member for the adjustment of the sensor sensitivity, and the controller may obtain a necessary amount of received reflected light.

In the image forming apparatus, the controller may determine at least one of a dirty level of the optical sensor and a damage level of the conveyor member by obtaining the amount of reflected light received by the optical sensor while the rotation for nondetection is performed.

The invention may be implemented in various aspects, e.g., a control device, a control method, a printing device, a printing method, a computer program for accomplishing functions of these methods or devices, or a recording medium storing such a computer program.

According to the invention, the rotation of the conveyor member to only obtain the amount of reflected light received by the optical sensor may be minimized.

Other objects, features, and advantages will be apparent to persons of ordinary skill in the art from the following detailed description of the invention and the accompanying drawings.

BRIEF DESCRIPTION OF THE DRAWINGS

For a more complete understanding of the present invention, needs satisfied thereby, and the objects, features, and advantages thereof, reference now is made to the following description taken in connection with the accompanying drawings.

DETAILED DESCRIPTION OF EMBODIMENTS OF THE INVENTION

Embodiments now are described in detail with reference to the accompanying drawings, like numerals being used for like corresponding parts in the various drawings.

Figure 1:
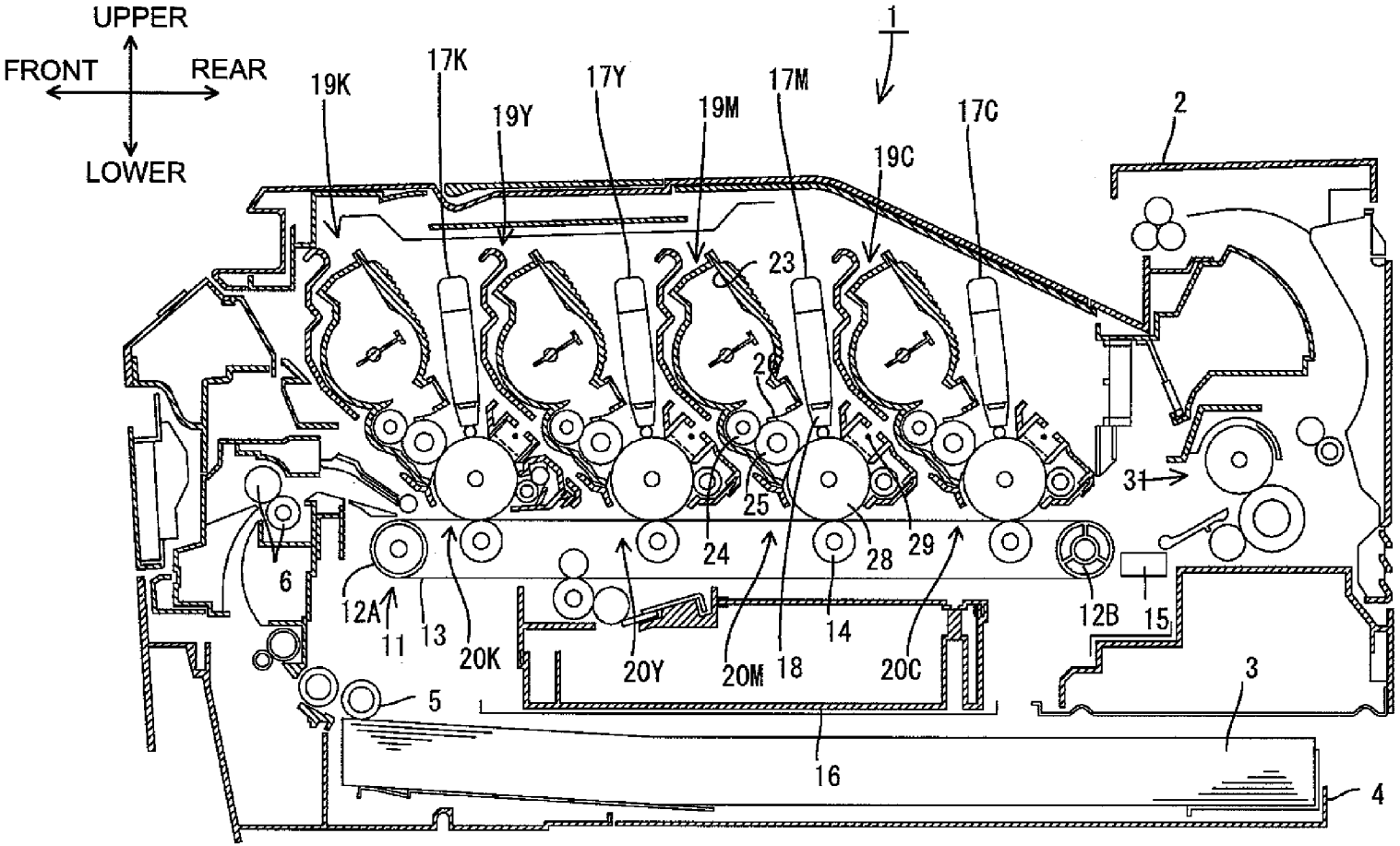
FIG. 1 is a cross-sectional view depicting a schematic configuration of a printer in an embodiment according to one or more aspects of the invention.

As depicted in FIG. 1, a printer 1 may be a tandem color printer using a multiple transfer method, in which printer 1 may form a color image using a plurality of colors of toner, e.g., black K, yellow Y, magenta M, and cyan C.

The left side of FIG. 1 may be a front side of printer 1, and the right side of FIG. 1 may be a rear side of printer 1. A direction perpendicular to the drawing sheet of FIG. 1 may be a right-left direction of printer 1. In the following descriptions, suffixes K (black), C (cyan), M (magenta), and Y (yellow), which represent the respective colors, are appended to the reference numerals of the components when distinguishing the components of the printer 1 by a respective color or distinguishing certain descriptive terms by the respective color.

Printer 1 may comprise a casing 2. Printer 1 also may comprise a tray 4 in a bottom portion of casing 2, which may be configured to hold a plurality of sheets 3, e.g., paper or an overhead transparency, therein. A pickup roller 5 may be disposed above the upper front end of tray 4. Pickup roller 5 may be rotationally driven and may feed an uppermost sheet 3 of the plurality of sheets 3 to a registration roller pair 6. Registration roller pair 6 may minimize skewing of sheet 3 and then may convey uppermost sheet 3 onto a belt unit 11.

Belt unit 11 may comprise a pair of support rollers 12A and 12B and an endless belt 13 which may be looped around pair of support rollers 12A and 12B. Endless belt 13 may be formed of a resin material, e.g., polycarbonate, and the surface of endless belt 13 may be mirror-finished. Rotation of support roller 12B, which may be disposed at the rear of endless belt 13, may drive endless belt 13 rotationally in a clockwise direction on the drawing sheet of FIG. 1, and endless belt 13 may hold uppermost sheet 3 on an upper surface of endless belt 13 and may convey uppermost sheet 3 in a rearward direction. A plurality, e.g., four, of transfer rollers 14 may be provided inside of the loop of endless belt 13. Transfer rollers 14 may face photosensitive members 28 of process units 19K, 19Y, 19M, 19C (described below), respectively, with endless belt 13 interposed therebetween.

A mark sensor 15 for determining the position of a mark M (See FIG. 3), which printer 1 may form on the surface of endless belt 13 when printer 1 performs a correction process (described below), may be disposed at a rear end side of endless belt 13. A cleaning device 16 may be disposed below belt unit 11. Cleaning device 16 may remove, for example, toner particles, which may comprise toner used for forming patterns for correction P (described below), and paper dust adhering to the surface of endless belt 13.

Printer 1 may comprise a plurality, e.g., four, of image forming units 20K, 20Y, 20M, 20C corresponding to the colors of black, yellow, magenta, and cyan, respectively. Each image forming unit of the plurality of image forming units 20K, 20Y, 20M, 20C may comprise one corresponding exposure unit of a plurality, e.g., four, of exposure units 17K, 17Y, 17M, 17C, one corresponding process unit of a plurality, e.g., four, of process units 19K, 19Y, 19M, 19C, and one transfer roller of a plurality, e.g., four, of transfer rollers 14. Each exposure unit of the plurality of exposure units 17K, 17Y, 17M, 17C and each process unit of the plurality of process units 19K, 19Y, 19M, 19C may be disposed above belt unit 11 and may be arranged in a row along the front-rear direction.

Each exposure unit of the plurality of exposure units 17K, 17Y, 17M, 17C may comprise a light-emitting diode ("LED") head 18. LED head 18 may comprise a plurality of LEDs (not depicted) which may be arranged in a line along the right-left direction of printer 1. Each exposure unit of the plurality of exposure units 17K, 17Y, 17M, 17C may emit light in a sequence based on data corresponding to an image to be formed in a color corresponding to the color of each exposure unit of the plurality of exposure units 17K, 17Y, 17M, 17C, and each exposure unit of the plurality of exposure units 17K, 17Y, 17M, 17C may expose surfaces of a corresponding opposing photosensitive member of a plurality of opposing photosensitive members 28 to light by emitting light from LED heads 18 on a line-by-line basis.

Hereinafter, the arrangement direction (the front-rear direction) of process units 19K, 19Y, 19M, 19C and, in particular, the arrangement direction of the plurality of photosensitive members 28, may be referred to as a "conveying direction." Further, a direction orthogonal to the conveying direction may be referred to as a "belt-width direction." In this embodiment, the belt-width direction may be parallel to the arrangement direction of the plurality of LEDs of each exposure unit of the plurality of exposure units 17K, 17Y, 17M, 17C.

Each process unit of the plurality of process units 19K, 19Y, 19M, 19C may comprise a toner chamber 23, a supply roller 24, a developing roller 25, and a layer thickness regulating blade 26. Toner chamber 23 may accommodate therein toner of corresponding color as a colorant. Toner accommodated in toner chamber 23 may be supplied onto supply roller 24. Supply roller 24 then may supply toner onto developing roller 25 by rotation and friction between supply roller 24 and developing roller 25 may charge positively the toner. The toner held on developing roller 25 then may enter between layer thickness regulating blade 26 and developing roller 25 by rotation of developing roller 25. Friction between layer thickness regulating blade 26 and developing roller 25 may sufficiently charged and the toner, which developing roller 25 then may hold as a thin layer with a uniform thickness.

Each process unit of the plurality of process units 19K, 19Y, 19M, 19C may comprise a photosensitive member 28 and a scorotron charger 29. Each photosensitive member 28 may comprise a surface covered by a positively chargeable photosensitive layer. When one or more of printing and mark detection is performed, photosensitive member 28 may rotate, and charger 29 may charge the surface of photosensitive member 28 positively and uniformly. Each exposure unit of the plurality of exposure units 17K, 17Y, 17M, 17C may expose the positively charged portion of the corresponding photosensitive member of the plurality of photosensitive members 28 to light. Accordingly, an electrostatic latent image may be formed on the surface of photosensitive member 28.

The toner on developing roller 25 may be supplied to the electrostatic latent image, so that the electrostatic latent image may be visualized into a toner image. The toner image formed on the surface of each photosensitive member of the plurality of photosensitive members 28 then may be transferred sequentially onto sheet 3 by a negative transfer voltage applied to transfer roller 14 while sheet 3 passes through each transfer position between each photosensitive member of the plurality of photosensitive members 28 and each corresponding transfer roller of the plurality of transfer rollers 14. Subsequently, belt unit 11 may convey sheet 3 having the toner image transferred thereonto a fixing device 31, and the toner image may be fixed thermally on sheet 3. Sheet 3 then may be conveyed upward and may be discharged to the upper surface of casing 2.

Figure 2:
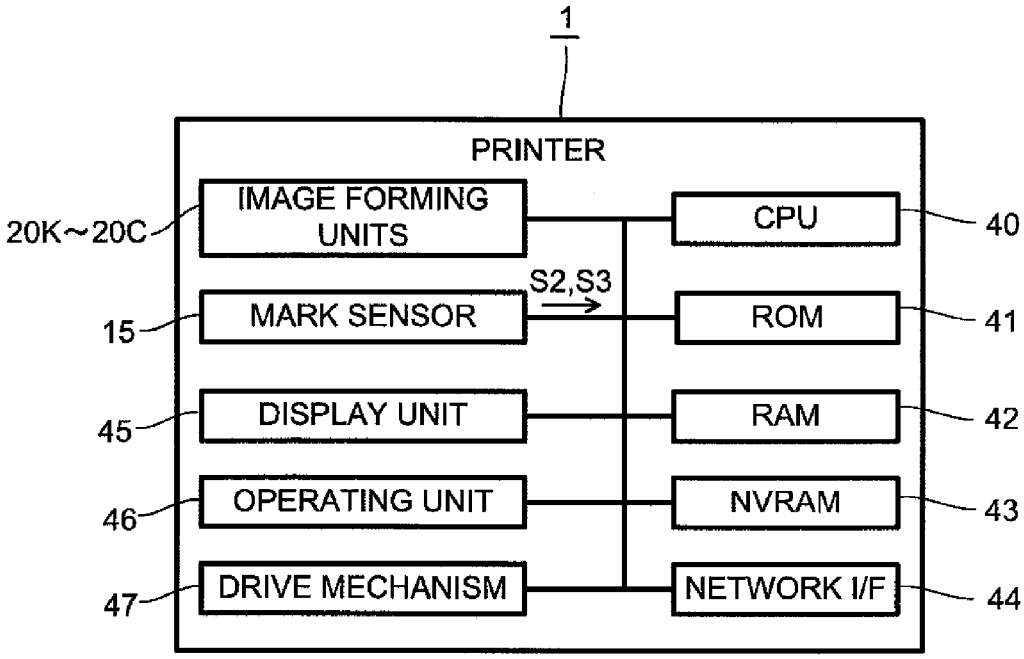
FIG. 2 is a block diagram schematically depicting an electrical configuration of the printer in the embodiment according to one or more aspects of the invention.

As depicted in FIG. 2, printer 1 may comprise a central processing unit ("CPU") 40, a read-only memory ("ROM") 41, a random-access memory ("RAM") 42, a nonvolatile random-access memory ("NVRAM") 43, and a network interface ("I/F") 44. Each image forming unit of the plurality of image forming units 20K, 20Y, 20M, 20C, mark sensor 15, a display unit 45, an operating unit 46, and a drive mechanism 47 may connect to one or more of CPU 40, ROM 41, RAM 42, NVRAM 43, and I/F 44.

ROM 41 may store programs for performing various operations of printer 1, a printing process (described below). CPU 40 may read the programs stored in ROM 41 and may control each component of printer 1 while storing processing results in one or more of RAM 42 and NVRAM 43, as instructed by each of the programs. Network interface 44 may access an external device, e.g., a computer, (not depicted) through a communication line, so that printer 1 may engage in data communication with the external device.

Display unit 45 may comprise a liquid crystal display and a tamp. Display unit 45 may display thereon various kinds of setting screens and operating states of devices. Operating unit 46 may comprise a plurality of buttons. A user may perform various kinds of input operations when using operating unit 46. Drive mechanism 47 may comprise a drive motor which may rotate endless belt 13.

Figure 3:
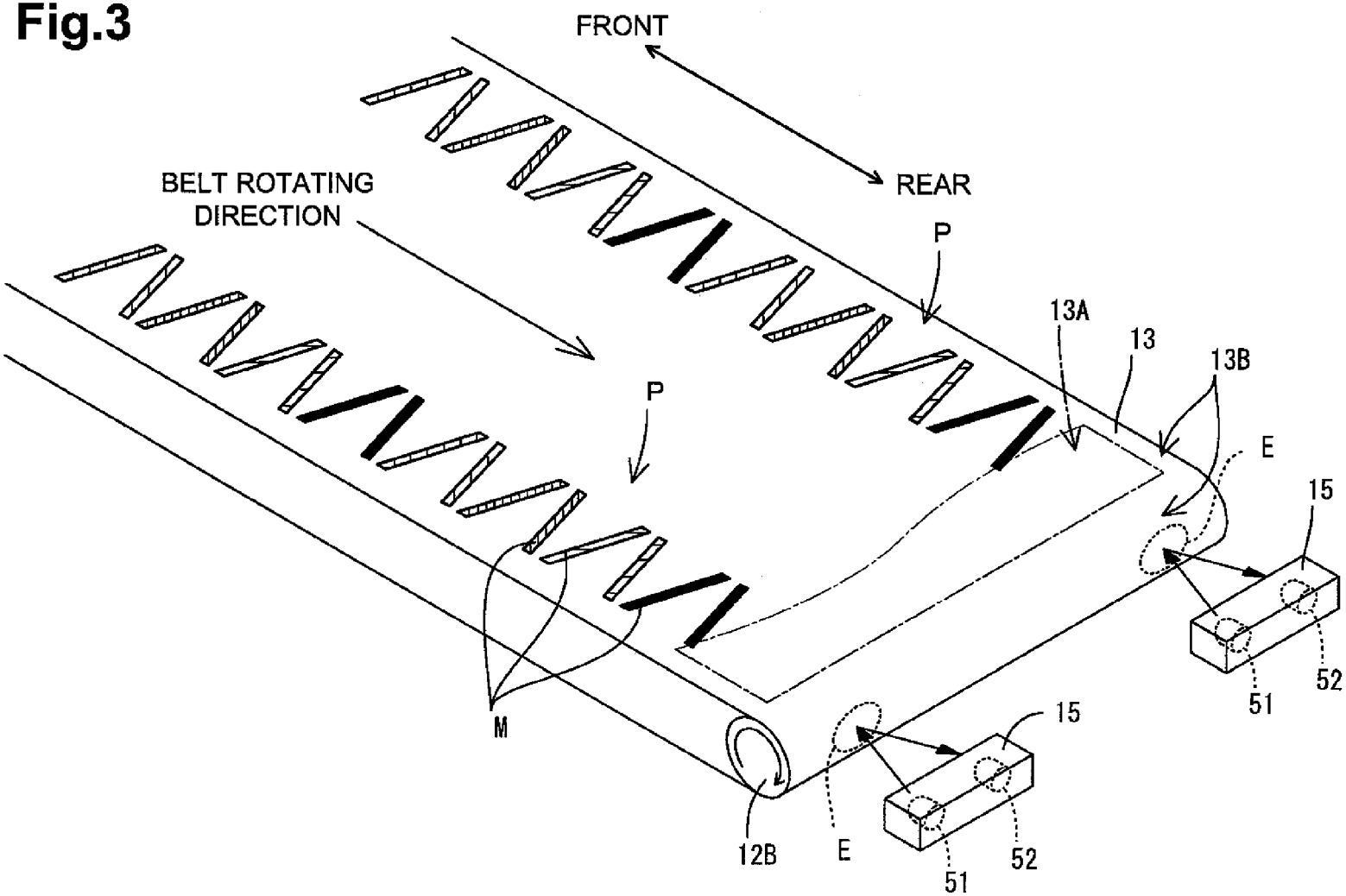
FIG. 3 is a perspective view depicting mark sensors and a belt in the embodiment according to one or more aspects of the invention.

As depicted in FIG. 3, one or more mark sensors 15 may be disposed at the lower rear side of endless belt 13, and mark sensors 15 may be arranged side-by-side along the right-left direction. Each mark sensor 15 may be a reflective-type optical sensor which may comprise a light emitting element 51, e.g., an LED, and a light receiving element 52, e.g., a phototransistor. Specifically, light emitting element 51 may irradiate the surface of endless belt 13 with light from an oblique direction, and light receiving element 52 may receive the light reflected from the surface of endless belt 13. A spot formed on endless belt 13 by the light from light emitting element 51 may be a detection area E (indicated by a dashed line in FIG. 3) of mark sensor 15.

Figure 4:
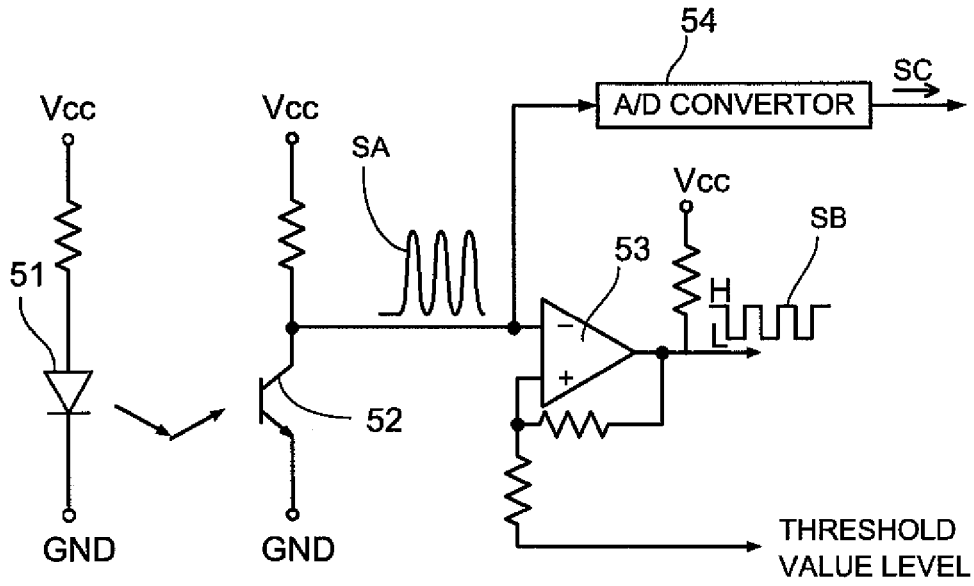
FIG. 4 depicts a circuit configuration of the mark sensors in the embodiment according to one or more aspects of the invention.

As depicted in FIG. 4, a light receiving signal SA from light receiving element 51 may change to a lower level as the amount of reflected light received in light receiving element 52 increases, and light receiving signal SA may change to a higher level as the amount of reflected light received in light receiving element 52 decreases. Light receiving signal SA may be input into a hysteresis comparator 53. Hysteresis comparator 53 may compare the level of light receiving signal SA with threshold values (e.g., a first threshold value TH1 and a second threshold value TH2) and may output a binary signal SB whose level may invert according to the comparison result. CPU 40 may obtain a digital signal SC converted from an analog signal by an A/D convertor 54, in addition to or in place of binary signal SB.

The printing process now is described with reference to FIG. 5. CPU 40 may perform the printing process when receiving print data from an external computer via network interface 44 or when receiving an input of a print command through operating unit 46, for example. During the printing process, CPU 40 may determine an adjustment value for a sensitivity of mark sensors 15.

First, CPU 40 may instruct drive mechanism 47 to rotate endless belt 13 (step S1), and, therefore, endless belt 13 may start rotating for printing. CPU 40 then may determine whether the printing to be performed is monochrome printing (step S2). Because a frequency of using black toner K is higher than a frequency of using toner of other colors Y, M, C, toner chamber 23 for black toner K may become empty before black toner K becomes unsuitable for printing due to deterioration. Because a frequency of using toner of colors Y, M, C is lower than a frequency of using black toner K, toner of colors Y, M, C may become unsuitable for printing due to deterioration before one or more of toner chambers 23 corresponding to toner of colors Y, M, C becomes empty. An amount of operation of process units 1.9K, 19Y, 19M, 19C may influence the toner deterioration. Thus, the toner stored in toner chambers 23 may be stressed when the amount of operation of process units 19K, 19Y, 19M, 19C increases. This may cause damages to build up in the toner. Subsequently, when the toner becomes deteriorated, a charging capability of toner may become unstable. As a result, the toner may adhere to unintended positions during printing, and printer 1 may not develop or transfer the images in an appropriate manner. Therefore, deteriorated toner of colors Y, M, C more likely may be scattered on endless belt 13, and, because it may be difficult to remove scattered toner from endless belt 13 during cleaning, deteriorated toner of colors Y, M, C more likely may remain on endless belt 13, as compared with black toner K. Dirty endless belt 13 may cause degradation in the accuracy of the sensitivity adjustment of mark sensors 15 because the amount of reflected light received by mark sensors 15 may vary, at the time of the sensor-sensitivity adjustment.

When the printing to be performed is color printing (step S2:NO), CPU 40 may perform printing to form a print image on a sheet 3 based on the print data without performing the sensor-sensitivity adjustment process (step S8) because yellow toner Y, magenta toner M, and cyan toner C may be used in the color printing. CPU 40 then may exit the printing process.

When the printing to be performed is monochrome printing (step S2:YES), CPU 40 may determine whether a total length of all sheets 3 to be used for printing along the conveying direction (hereinafter, briefly referred to as a total sheet length) is greater than or equal to a reference length (step S3). When a plurality of sheets are to be used for printing, the total sheet length may be a value which is a sum total of the length of each sheet 3 to be used for printing. The reference length may be a value which corresponds to the distance a point on endless belt 13 travels as endless belt 13 rotates in order to sample, from mark sensors 15, the number of digital signals SC required for flue adjustment during the sensor-sensitivity adjustment process (described below).

In this embodiment, digital signals SC may need to be sampled thirty (30) times at predetermined time intervals for fine adjustment. For example, when a sheet 3 to be used for printing has a standard A4-size, the reference length may be a length of three sheets. When a sheet 3 to be used for printing has a standard B5-size, the reference length may be a length of five sheets. As described above, the reference length corresponds to the number of sheets 3 of a particular sheet size which have a total sheet length based on sampling conditions, and to the reference length may be greater than or equal to the circumference of endless belt 13. By using digital signals SC outputted from mark sensors 15 when mark sensors 15 detect marks M formed on the circumference of endless belt 13, the image forming apparatus may minimize variations in the reflectance on the surface of endless belt 13. Thus, the image forming apparatus may finely adjust the sensor sensitivity. Hereinafter, a description is made in an exemplary case in which a sheet 3 to be used for printing may have a standard A4-size.

When the total sheet length is less than the reference length (step S3:NO) and a time, which has elapsed from the previous sensor-sensitivity adjustment, is less than or equal to a reference time (step S4:NO), CPU 40 may perform printing based on the print data without performing the sensor-sensitivity adjustment process (step S9). CPU 40 then may exit the printing process. For example, CPU 40 may measure the elapsed time using an internal clock and may prestore the reference time in NVRAM 43.

When the total sheet length is greater than or equal to the reference length, i.e., three or more sheets 3 are to be used for printing (step S3:YES), CPU 40 may determine whether a width of sheets 3 to be used for printing in a direction orthogonal to the sheet conveying direction (hereinafter, briefly referred to as a sheet width) is greater than or equal to a reference width (step S5). The reference width may be substantially the same as a distance between detection areas E of mark sensors 15. When the sheet width is greater than or equal to the reference width (step S5:YES), CPU 40 may perform printing and the sensor-sensitivity adjustment process (step S6). In this case, an area, i.e., a conveyance area 13A (See FIG. 3), of endless belt 13 may be used for holding and conveying sheets 3 during printing. Conveyance area 13A may have a length and a width greater than or equal to the reference length and the reference width, respectively, and conveyance area 13A may be covered with sheets 3 to be used for printing, e.g., conveyance area 13A may be the area of endless belt 13 covered by sheets 3 during printing.

When the time elapsed from the previous sensor-sensitivity adjustment exceeds a reference time (step S4:YES), although the total sheet length is less than the reference length (step S3:NO), the image forming apparatus may need to perform the sensor-sensitivity adjustment process. Accordingly, when the sheet width is greater than or equal to the reference width (step S5:YES), the image forming apparatus may perform the printing and the sensor-sensitivity adjustment process (step S6). In this case, the size of conveyance area 13A may be less than the reference length and may be greater than or equal to the reference width for the printing to be performed.

When the sheet width is less than the reference width, e.g., a sheet 3 to be used for printing has a postcard-size (step S5:NO), a nonconveyance area 13B, which may be a part of endless belt 13 and may not be used for holding and conveying a sheet 3 during printing, may pass detection areas E. Because nonconveyance area 13B of endless belt 13 may not hold sheet 3 thereon and may be bare, nonconveyance area 13B may catch toner more easily than conveyance area 13A while endless belt 13 passes under each image forming unit of the plurality of image forming units 20K, 20Y, 20M, 20C. In addition, the amount of reflected light received by mark sensors 15 may vary at the dirty surface of endless belt 13 during the sensor-sensitivity adjustment, and therefore, the accuracy of the sensor-sensitivity adjustment may be degraded. Accordingly, in this case, CPU 40 may perform the printing based on the print data (step S8) without performing the sensor-sensitivity adjustment process and then may exit the printing process.

Figure 6:
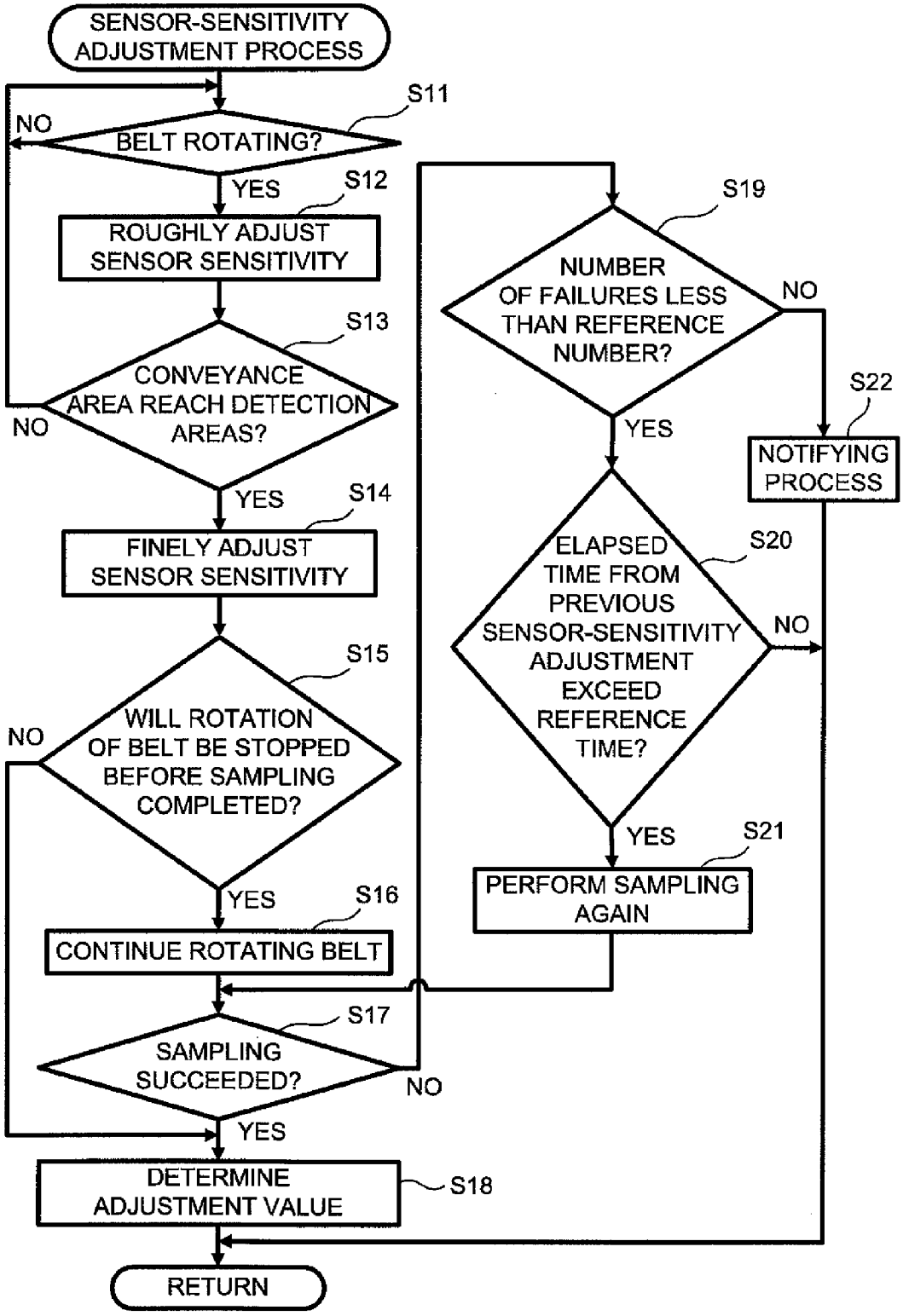
FIG. 6 is a flowchart of a sensor-sensitivity adjustment process in the embodiment according to one or more aspects of the invention.

When the sheet width is greater than or equal to the reference width (step S5:YES), CPU 40 may perform the printing based on the print data and the sensor-sensitivity adjustment process (step S6) depicted in FIG. 6. First, CPU 40 may determine whether endless belt 13 is rotating (step S11). When endless belt 13 rotates (step S11:YES), CPU 40 may perform the sensor-sensitivity rough adjustment (step S12). In the rough adjustment, CPU 40 may determine an adjustment value for the sensor-sensitivity with relatively low accuracy. At that time, CPU 40 may function as a determining portion.

Figure 7:
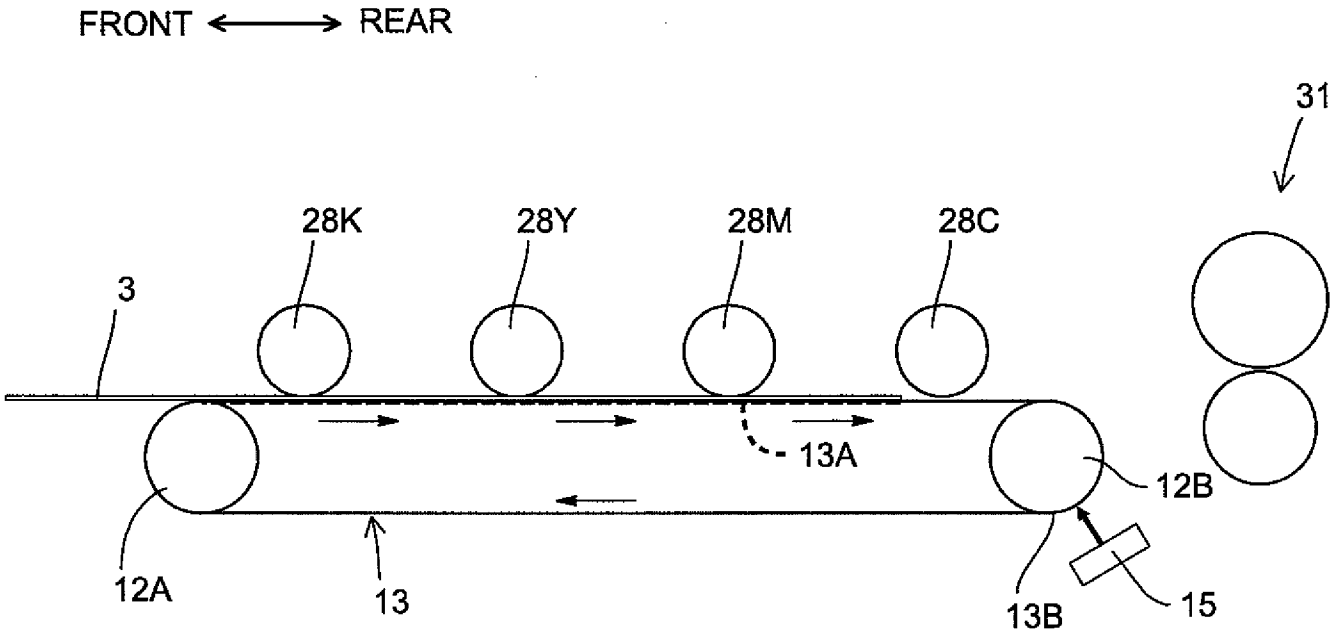
FIG. 7 is a schematic view depicting a belt unit wherein a nonconveyance area of the belt passes detection areas in the embodiment according to one or more aspects of the invention.

More specifically, the number of times digital signals SC are sampled in the rough adjustment may be less than the number of times digital signals SC are sampled in a sensor-sensitivity fine adjustment (described below). For example, CPU 40 may sample digital signals SC ten (10) times at intervals of unit time, e.g., 0.3 seconds, while endless belt 13 is rotating. In addition, CPU 40 may sample digital signals SC in the rough adjustment while nonconveyance area 13B passes detection areas F as depicted in FIG. 7.

Then, CPU 40 may determine an adjustment value of the sensor-sensitivity based on digital signals SC of ten (10) samplings, such that the amount of reflected light received by mark sensors 15 becomes a predetermined level. The adjustment value may be one or more of an amount of light emitted from light emitting element 51, an amplification level, and a degree of offset of receiving signals SA from light receiving element 52. CPU 40 may adjust sensor sensitivity by changing at least one of the amount of light emitted from light emitting element 51, the amplification level of receiving signals SA from light receiving element 52, and the degree of offset of receiving signals SA from light receiving element 52. CPU 40 may adjust the sensor sensitivity by using the adjustment value and then may wait until conveyance area 13A reaches detection areas E (step S13:NO). The timing of conveyance area 13A reaching detection areas E may be determined from, for example, determining the time from one of when registration roller pair 6 sending a sheet 3 therefrom and from when a leading edge of a sheet 3 is detected near fixing unit 31 until conveyance area 13A reaches detection areas E.

Figure 8:
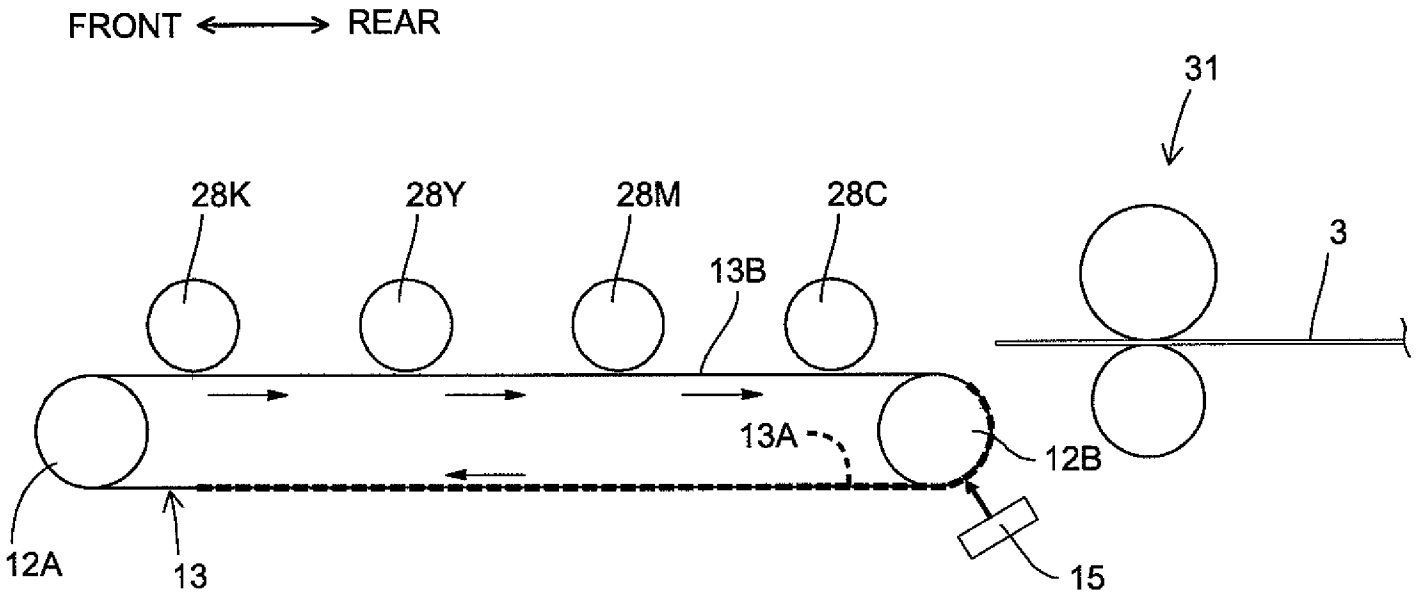
FIG. 8 is a schematic view illustrating the belt unit wherein a conveyance area of the belt passes the detection areas in the embodiment according to one or more aspects of the invention.

As depicted in FIG. 8, when conveyance area 13A reaches detection areas E (step S13:YES), CPU 40 may perform the sensor-sensitivity fine adjustment (step S14). In the sensor-sensitivity fine adjustment, an adjustment value of the sensor sensitivity may be determined with higher accuracy than that in the rough adjustment. More specifically, the number of times digital signals SC are sampled in the fine adjustment may be greater than the number of times digital signals SC are sampled in the rough adjustment. For example, CPU 40 may sample digital signals SC thirty (30) times at intervals of unit time, e.g., 0.3 seconds, while endless belt 13 rotates. CPU 40 then may determine whether the rotation of endless belt 13 stops before the sampling of digital signals SC for fine adjustment is completed (step S15).

For example, when the total sheet length is greater than or equal to the reference length (step S3:YES) and the sheet width is greater than or equal to the reference width (step S5:YES), CPU 40 may complete sampling of digital signals SC for fine adjustment before endless belt 13 stops rotating at the completion of the printing because the total length of conveyance area 13A of endless belt 13 is greater than or equal to the reference length (step S15:NO). For example, CPU 40 may determine an adjustment value for the sensor sensitivity based on digital signals SC of thirty (30) samplings, such that the amount of reflected light received by mark sensors 15 becomes a predetermined level, and CPU 40 may store the determined adjustment value in NVRAM 43.

When the total sheet length is less than the reference length (step S3:NO) and the sheet width is greater than or equal to the reference width (step S5:YES), CPU 40 may stop rotation of endless belt 3 at the completion of the printing before completing the sampling of digital signals SC for fine adjustment because the total length of conveyance area 13A is less than the reference length (step S15:YES). In this case, CPU 40 may continue to rotate endless belt 13 after the printing is completed and until CPU 40 obtains the required number of samplings of digital signals SC for fine adjustment. (step S16) CPU 40 may stop rotation of endless belt 13 when CPU 40 obtains a required number of samplings, e.g., thirty (30), of digital signals SC for fine adjustment (step S17:YES). The routine then may move to step S18.

In this case, digital signals SC may comprise digital signals SC obtained based on the amount of received light reflected from conveyance area 13A and digital signals SC based on the amount of received light reflected from nonconveyance area 13B. The amount of received light reflected from conveyance area 13A may be less influenced by matter, e.g., toner, on endless belt 13 than the amount of received light reflected from nonconveyance area 13B. Therefore, CPU 40 may determine an adjustment value by using the amount of received light reflected from conveyance area 13A and the amount of received light reflected from nonconveyance area 13B and by assigning weighting factors to these amounts of received light, wherein the weighting factor assigned to the amount of received light reflected from conveyance area 13A may be greater than the weighting factors assigned to the amount of received light reflected from nonconveyance area 13B (step S18). More specifically, for example, CPU 40 may obtain a weighted average between the amount of received light reflected from conveyance area 13A and the amount of received light reflected from nonconveyance area 13B. At that time, CPU 40 may set a coefficient associated with the amount of received light reflected from conveyance area 13A to be greater than a coefficient associated with the amount of received light reflected from nonconveyance area 13B. CPU 40 may obtain the adjustment value based on the obtained weighted average. For example, when the coefficient associated with the amount of received light reflected from nonconveyance area 13B is 1, the coefficient associated with the amount of received light reflected from conveyance area 13A may be between 2 and 5, or, when the coefficient associated with the amount of received light reflected from nonconveyance area 13B is 0, the coefficient with respect to the amount of received light reflected from conveyance area 13A may be 1. For example, when the coefficient associated with the amount of received light reflected from nonconveyance area 13B is 1 and the coefficient associated with the amount of received light reflected from conveyance area 13A is 4, CPU 40 may obtain a weighted average therebetween by using the formula below.

Weighted average=(4×Amount of received light reflected from conveyance area+1×Amount of received light reflected from nonconveyance area)/(4+1)

When the sampling of digital signals SC fails, e.g., when noise causes an unusual level in digital signals SC (step S17:NO), CPU 40 may determine whether the number of failures is less than a reference number (step S19). When the number of failures is greater than or equal to the reference number (step S19:NO), CPU 40 may perform a notifying process to display, on display unit 45, an error notice indicating that the adjustment value may not be determined (step S22). CPU 40 then may stop rotation of endless belt 13 and may exit the sensor-sensitivity adjustment process.

When the number of failures is less than the reference number (step S19:YES), CPU 40 may determine whether a time, which has elapsed from the previous sensor-sensitivity adjustment, is greater than a reference time (step S20). When the time elapsed from the previous sensor-sensitivity adjustment is less than or equal to the reference time (step S20:NO), CPU 40 may stop rotation of endless belt 13 without determining the adjustment value. CPU 40 then may exit the sensor-sensitivity adjustment process. When the time elapsed from the previous sensor-sensitivity adjustment is greater than the reference time (step S20:YES), CPU 40 may determine that the sensor-sensitivity needs to be adjusted, and CPU 40 may sample digital signals SC again (step S21). The routine then may move to step S17.

After the sensor-sensitivity adjustment process, CPU 40 may determine a signal level (dirt level) corresponding to an amount of dirt, e.g., toner, adhering to at least one of light emitting element 51 and light receiving element 52. Further, CPU 40 may determine a signal level (damage level) corresponding to an amount of damage to endless belt 13. CPU 40 may instruct display unit 45 to display one or more of the determination results (step S7). CPU 40 then may exit the printing process. Consequently, CPU 40 may minimize additional rotation of endless belt 13 related to determining the dirt level and the damage level. CPU 40 may function as a judging portion.

Figure 9:
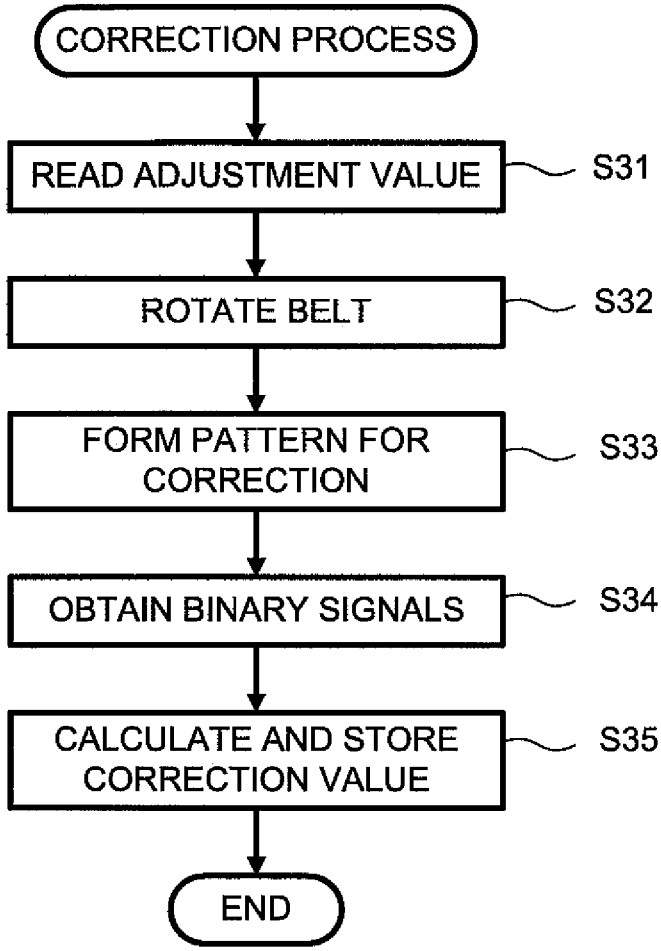
FIG. 9 is a flowchart of a correction process in the embodiment according to one or more aspects of the invention.

Next, the correction process is described with reference to FIG. 9. CPU 40 may perform the correction process when predetermined criteria are met, e.g., when one or more of image forming unit 20 and belt unit 11 is replaced with a new unit, when a predetermined period of time has elapsed since the previous correction process was performed or when the number of printed pages reaches a predetermined number.

At the time CPU 40 performs the correction process, CPU 40 may already have determined the adjustment value for the sensor sensitivity during the printing process, such that CPU 40 may not rotate endless belt 13 further to sample of digital signals SC corresponding to the light reflected from the surface of endless belt 11 CPU 40 may read the determined adjustment value from NVRAM 43 (step S31). Then, CPU 40 may specify the sensor sensitivity and may instruct drive mechanism 47 to rotate endless belt 13 (step S32).

Then, as depicted in FIG. 3, the image forming device may form patterns for correction P comprising marks M of respective colors on endless belt 13 (step S33). CPU 40 may obtain binary signals SB (step S34) and may detect marks M based on binary signals SB. At that time, CPU 40 may function as a mark detecting portion. CPU 40 may calculate, from the detection result of marks M, a correction value to adjust for deviations of images among colors (step S35), and CPU 40 then may store the correction value in NVRAM 43. CPU 40 then may exit the correction process. Patterns for correction P may comprise marks M for color-density correction.

According to the embodiment, the amount of reflected light received by mark sensors 15 for sensor-sensitivity adjustment may be obtained during the rotation for nondetection, in which endless belt 13 may rotate for a further purpose other than mark detection. Accordingly, the above-described process may minimize additional rotation of endless belt 13 related to obtaining the amount of reflected light received by mark sensors 15.

Compared with nonconveyance area 13B of endless belt 13, conveyance area 13A of endless belt may catch minimal amounts of toner particles and dust on the surface thereof because a sheet 3 thereon separates plurality of image forming units 20K, 20Y, 20M, 20C from the surface of endless belt 13 when plurality of image forming units 20K, 20Y 20M, 20C form a print image on sheet 3. According to the embodiments, CPU 40 may determine the adjustment value by using the amount of received light reflected from conveyance area 13A. Consequently, CPU 40 may improve the accuracy of the sensor sensitivity compared to a case in which CPU 40 determines an adjustment value by using the amount of received light reflected from nonconveyance area 13B only because mark sensors may receive a larger amount of light, which is hardly influenced by the colorants. In particular, in an electrophotographic image forming apparatus, toner may excessively adhere to photosensitive member 28 due to damage to photosensitive member 28 which may create a greater likelihood that toner may adhere on endless belt 13. Therefore, using conveyance area 13A during the sensor-sensitivity adjustment may enhance the sensor-sensitivity adjustment.

According to the embodiments, CPU 40 may use conveyance area 13A during the sensor-sensitivity adjustment only when the total sheet length is greater than or equal to the reference length or when the sheet width is greater than or equal to the reference width. Consequently, CPU 40 may obtain the amount of received light that is less influenced by toner, and CPU 40 may adjust the sensor sensitivity with higher accuracy compared to a case where CPU 40 may use conveyance area 13A during the sensor-sensitivity adjustment regardless of the sheet length and width.

According to the embodiment, CPU 40 may determine the adjustment value by using both the amount of received light reflected from conveyance area 13A and the amount of received light reflected from nonconveyance area 13B and by assigning weighting factors to these amounts of received light, wherein the weighting factor assigned to the amount of received light reflected from conveyance area 13A may be greater than the weighting factors assigned to the amount of received light reflected from nonconveyance area 13B (step S3:NO and step S5:YES). Thus, CPU 40 may determine the adjustment value by placing more importance on the amount of received light reflected from conveyance area 13A than on the amount of received light reflected from nonconveyance area 13B. Therefore, the influence of toner on the sensor-sensitivity adjustment may be minimized compared to a case in which CPU 40 places less importance on the amount of received light reflected from conveyance area. 13A than on the amount of received light reflected from nonconveyance area 13B or a case in which CPU 40 places no importance on the amount of received light reflected from conveyance area 13A.

Figure 5:
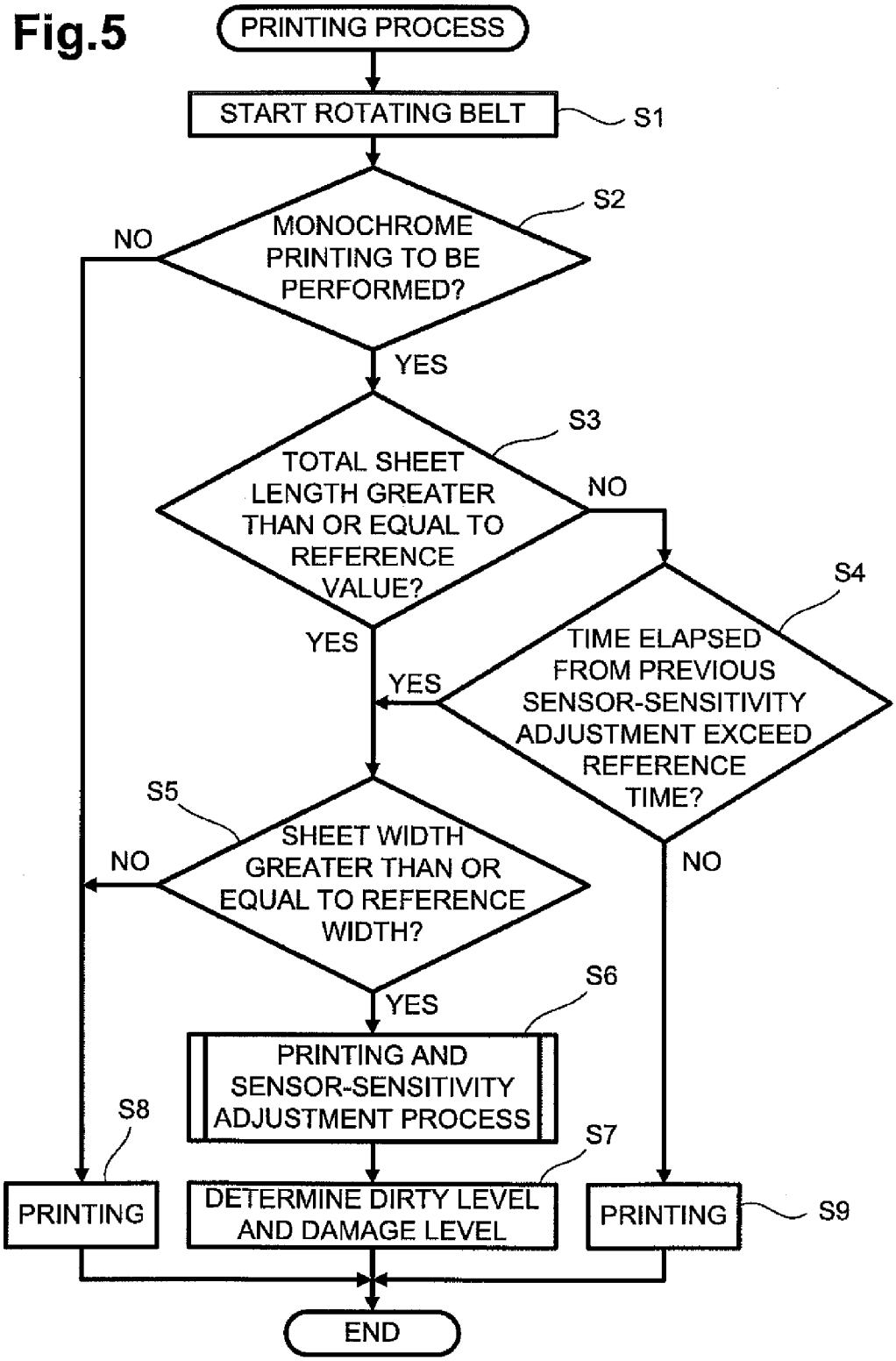
FIG. 5 is a flowchart of a printing process in the embodiment according to one or more aspects of the invention.

According to the embodiment, in the process which uses conveyance area 13A during the sensor-sensitivity adjustment, CPU 40 may determine the adjustment value for the sensor sensitivity based on the amount of received light reflected from conveyance area 13A only (step S3:YES and step S5:YES in FIG. 5). Therefore, the influence of toner on the sensor-sensitivity adjustment may be minimized compared to a case where CPU 40 determines an adjustment value by using both the amount of received reflected light at conveyance area 13A and the amount of received reflected light at nonconveyance area 13B.

According to the embodiment, when CPU 40 determines that the sampling will not be completed during printing (step S15:YES in FIG. 6), CPU 40 may continue to rotate endless belt 13 to obtain the amount of received reflected light required for the sensor-sensitivity adjustment. Accordingly, CPU 40 may determine the adjustment value by effectively using the amount of received reflected light that has been obtained even when the sampling is not completed during printing.

CPU 40 may determine whether an image forming apparatus performs the entire correction process or part of the correction process, as described in the embodiment. When the image forming apparatus comprises a memory that stores an adjustment value of the sensitivity of an optical sensor therein, CPU 40 may determine that the image forming apparatus performs at least part of the correction process when the adjustment value stored in the memory is different after endless belt 13 performs a rotation for nondetection, e.g., before and after printing is performed.

At that time, if the amount of reflected light received by the optical sensor is forcefully changed by changing the reflectance of the surface of endless belt 13 before and after the rotation for nondetection is performed, the change of the adjustment value before and after printing is performed may be brought to the fore. Thus, CPU 40 more readily may make the determination whether the image forming apparatus performs the entire correction process or part of the correction process. Alternatively, CPU 40 may determine whether the image forming apparatus performs the entire correction process or part of the correction process by detecting the change of an object to be adjusted after performing the rotation for nondetection. For example, CPU 40 may make the determination by detecting the change in the amount of reflected light received by the optical sensor based on the amount of reflected light received by the optical sensor after performing the rotation for nondetection compared to the amount of reflected light before performing the rotation for nondetection, i.e., the change in an amplification level or a degree of offset in accordance with the variations in the level of the light receiving signal. CPU 40 may detect the change in the amount of emitting light and CPU 40 may use the detected change for the determination.

The invention may be applied to a structure in which CPU 40 may determine at least one of a signal level (dirt level) corresponding to an amount of dirt, e.g., toner, adhering to an optical sensor and a signal level (damage level) corresponding to an amount of damage to a conveyor member by obtaining an amount of reflected light received by the optical sensor when the image forming apparatus performs a function requiring the conveyor member to rotate, e.g., when performing a cleaning or a belt loosening preventing function during printing.

For example, in the printing process, CPU 40 may determine at least one of the dirt level and the damage level (step S7) based on sampled receiving signals SA without determining an adjustment value for the sensor sensitivity. Accordingly, CPU 40 may reduce or minimize additional rotation of endless belt 13 related to obtaining the amount of received reflected light for determining the dirt level and the damage level.

In the above-described embodiment, the image forming apparatus of the invention may be a tandem printer using a multiple transfer method. Nevertheless, the invention may not be limited to the specific embodiment thereof, and the image forming apparatus may be a printer using a multiple transfer method with a transfer member or a printer using a multiple development method (e.g., a multiple rotation type or a single pass type). In this case, a photosensitive member may be an example of the conveyor member that conveys an electrostatic latent image and a toner image, and a developing unit and a charger may be an example of the image forming unit.

An intermediate transfer type printer using a multiple transfer method (e.g., a tandem type in an intermediate transfer method) may be used. In this case, an intermediate transfer member and a photosensitive member may be an example of the conveyor member that conveys an electrostatic latent image and a toner image. A developing unit and a charger may be an example of the image forming unit. Further, the image forming apparatus may be one or more image forming apparatuses using other electrophotographic methods, e.g., a polygon scanning method or an inkjet method.

In the above-described embodiments, CPU 40 may determine the adjustment value for the sensor sensitivity while endless belt 13 rotates for printing. Nevertheless, the rotation for nondetection of the invention may not be limited to the specific embodiment thereof. For example, an image forming apparatus may have a function of preventing endless belt 13 from loosening by rotating further endless belt 13 a predetermined time period when CPU 40 stops rotating endless belt 13 for printing. In the image forming apparatus, the sensor-sensitivity adjustment process of FIG. 6 may be performed while CPU 40 is rotating endless belt 13 for cleaning device 16 to clean endless belt 13.

In the embodiments, CPU 40 may perform the sensor-sensitivity adjustment process on the condition that monochrome printing is to be performed. Nevertheless, the invention may not be limited to the specific embodiments thereof. CPU 40 may perform the sensor-sensitivity adjustment process on a condition that color printing is to be performed. CPU 40 may perform the sensor-sensitivity adjustment process on a condition that the number of image forming units of the plurality of image forming units 20K, 20Y, 20M, 20C to be used in printing is less than a specified number, e.g., two. The above-described structure may allow the conveyor member to catch less colorants thereon than a structure where the amount of reflected light received by the optical sensor is obtained when the number of image forming units of the plurality of image forming units 20K, 20Y, 20M, 20C to be used in printing is greater than or equal to the specified number. Consequently, the above-described structure may minimize the influence of the colorants on the sensor-sensitivity adjustment may be minimized.

In the embodiments, CPU 40 may sample digital signals SC plural times to determine the adjustment value for the sensor sensitivity. Nevertheless, the invention may not be limited to the specific embodiments thereof. For example, CPU 40 may sample binary signal SB one time or for a predetermined time period. Accordingly, CPU 40 may sample binary signals SB for a predetermined time period in the above-described embodiment. A time period over which CPU 40 performs sampling for fine adjustment may be longer than a time period over which CPU 40 performs sampling for rough adjustment.

In the embodiments, the number of times the signals are sampled may be different between the rough adjustment and the fine adjustment, although the unit time, which may be the sampling interval, may be the same therebetween. Nevertheless, the invention may not be limited to the specific embodiment thereof. The image forming apparatus may set the unit time for fine adjustment to be shorter than the unit time for rough adjustment. Thus, the accuracy of determining the adjustment value of the sensor sensitivity may be different between the fine adjustment and the rough adjustment.

In the above-described embodiments, single CPU 40 may perform all of the printing process and the correction process. Nevertheless, the invention may not be limited to the specific embodiment thereof, and a plurality of CPUs, or a special application specific integrated circuit ("ASIC"), may be used to perform the printing process and the correction process. Different CPUs may perform the adjustment value determination process, and the dirt level and damage level determination, as well.

While the invention has been described in connection with various example structures and illustrative embodiments, it will be understood by those skilled in the art that other variations and modifications of the structures and embodiments described above may be made without departing from the scope of the invention. For example, this application comprises any possible combination of the various features disclosed or claimed herein, and the particular features presented in the claims and disclosed above may be combined with each other in other manners within the scope of the application, such that the application should be recognized as also directed to other embodiments comprising any other possible combinations. Other structures and embodiments will be apparent to those skilled in the art from a consideration of the specification or practice of the invention disclosed herein. It is intended that the specification and the described examples are illustrative with the true scope of the invention being defined by the following claims.

What is claimed is:

1. An image forming apparatus comprising:

a conveyor member configured to rotate;

an optical sensor comprising:

a light emitting portion configured to emit light toward the conveyor member; and a light receiving portion configured to receive reflected light that is reflected from the conveyor member;

an image forming portion configured:

to form a print image onto an image recording medium; and to form a mark onto one or more of the conveyor member and the image recording medium when the optical sensor performs a mark detection;

a drive portion configured to perform:

a rotation for detection, wherein the drive portion is configured to rotate the conveyor member while the optical sensor performs the mark detection; and a rotation for nondetection, wherein the drive portion is configured to rotate the conveyor member while the conveyor member performs another function distinct from the mark detection; and a controller configured:

to obtain an amount of reflected light received by the optical sensor, while the rotation for nondetection is performed;

to adjust a value of sensitivity for the optical sensor based on the amount of reflected light received by the optical sensor; and to detect the mark with the optical sensor with the adjusted value of sensitivity while the rotation for detection is performed, wherein the conveyor member is a medium conveyor member configured to convey the image recording medium during the forming of the print image on the image recording medium by the image forming portion, wherein the rotation for nondetection comprises at least one of:

rotation of the conveyor member while forming the print image on the image recording medium, wherein the forming the print image on the image recording medium comprises one of:

printing the print image on the image recording medium, and printing the print image on the conveyor member and transferring the print image from the conveyor member to the image recording medium;

rotation of the conveyor member to clean the conveyor member by rotating the conveyor member while a cleaning device cleans the conveyor member; and rotation of the conveyor member to prevent loosening of the conveyor member by rotating the conveyor member for a predetermined time period after printing of the print image on the image recording medium, wherein the controller is configured to use a conveyance area to determine an amount of adjustment for the value of the sensitivity for the optical sensor by using an amount of the received light reflected at least from a portion of the conveyance area, when at least one of a plurality of criteria is met, wherein the at least one of the plurality of criteria is selected from the group consisting of:

a length of the image recording medium in a rotating direction of the conveyor member is greater than or equal to a predetermined reference length, and a width of the image recording medium in a direction orthogonal to the rotating direction is greater than or equal to a predetermined reference width, and wherein the conveyance area is a portion of a surface of the conveyor member and is equivalent in size to an image recording medium area.

2. The image forming apparatus according to claim 1, wherein the controller is configured not to use the conveyance area to determine the amount of adjustment for the value of the sensitivity for the optical sensor when each criteria of the plurality of criteria is not met.

3. The image forming apparatus according to claim 1, wherein the rotation for nondetection comprises the rotation of the conveyor member while forming the print image on the image recording medium, and wherein the controller is configured to use a conveyance area of the conveyor member to determine an amount of adjustment for the value of the sensitivity for the optical sensor by using an amount of the received light reflected at least from a portion of the conveyance area.

4. The image forming apparatus according to claim 3, wherein the controller is configured to determine the amount of adjustment for the value of the sensitivity for the optical sensor based on the amount of the received light reflected from the conveyance area and an amount of the received light reflected from a nonconveyance area, wherein the nonconveyance area is a portion of the surface of the conveyor member other than the conveyance area, wherein the controller is configured to assign respective weighting factors to the amount of the received light reflected from the conveyance area and the amount of the received light reflected from the nonconveyance area, and wherein a weighting factor assigned to the amount of the received light reflected from the conveyance area is greater than a weighting factor assigned to the amount of the received light reflected from the nonconveyance area.

5. The image forming apparatus according to claim 3, wherein the controller is configured to determine the amount of adjustment for the value of the sensitivity for the optical sensor based on the amount of the received light reflected from an entirety of the conveyance area.

6. The image forming apparatus according to claim 1, wherein the image forming portion comprises a plurality of image forming units; and wherein the controller is configured:

to determine a number of image forming units to be used in printing of the print image on the image recording medium;

not to use the amount of the reflected light received by the optical sensor during forming the print image to determine the amount of adjustment for the value of the sensitivity for the optical sensor when the number of image forming units to be used in printing of the print image on the image recording medium is greater than or equal to a predetermined reference number; and to use the amount of the reflected light received by the optical sensor during forming the print image to determine the amount of adjustment for the value of the sensitivity for the optical sensor when the number of image forming units to be used in printing of the print image on the image recording medium is less than the predetermined reference number.

7. The image forming apparatus according to claim 1, wherein the controller is configured to obtain the amount of reflected light received by the optical sensor a predetermined number of times to determine the amount of adjustment for the value of the sensitivity for the optical sensor; and wherein, when the controller does not obtain the amount of reflected light received by the optical sensor the predetermined number of times while the drive portion performs the rotation for nondetection, the drive portion is configured to continue to rotate the conveyor member until the amount of reflected light received by the optical sensor has been obtained the predetermined number of times.

8. The image forming apparatus according to claim 1, wherein the controller is configured to determine at least one of a dirt level of the optical sensor and a damage level of the conveyor member by obtaining the amount of the reflected light received by the optical sensor.

9. The image forming apparatus according to claim 1, wherein the controller is configured to sample the amount of the reflected light received by the optical sensor a predetermined number of times during a predetermined time period to determine the amount of adjustment for the value of the sensitivity for the optical sensor; and wherein, when the controller does not sample the amount of the reflected light received by the optical sensor the predetermined number of times while the drive portion performs the rotation for nondetection during the predetermined time period, the drive portion is configured to continue to rotate the conveyor member until the controller has sampled the amount of the reflected light received by the optical sensor the predetermined number of times.

10. The image forming apparatus according to claim 1, wherein the rotation for nondetection comprises the rotation of the conveyor member to clean the conveyor member by rotating the conveyor member while the cleaning device cleans the conveyor member.

11. The image forming apparatus according to claim 1, wherein the rotation for nondetection comprises the rotation of the conveyor member to prevent loosening of the conveyor member by rotating the conveyor member for the predetermined time period after printing of the print image on the image recording medium.

12. A method for controlling an image forming apparatus, the image forming apparatus comprising:

a conveyor member configured to rotate;

an optical sensor comprising:

a light emitting portion configured to irradiate the conveyor member with light; and a light receiving portion configured to receive light reflected from the conveyor member; and an image forming portion configured:

to form a print image onto an image recording medium; and to form a mark for correction onto one or more of the conveyor member and the image recording medium when the optical sensor performs a mark detection, wherein the conveyor member is a medium conveyor member configured to convey the image recording medium during the forming of the print image on the image recording medium, the method comprising the steps of:

obtaining an amount of reflected light received by the optical sensor and adjusting a value of sensitivity for the optical sensor based on the amount of reflected light received by the optical sensor, while a rotation for nondetection, in which the conveyor member performs another function distinct from the mark detection, is performed; and performing a mark detecting process in which the optical sensor detects the mark with the adjusted value of sensitivity while a rotation for detection, in which the conveyor member is rotated while the optical sensor performs the mark detection, is performed, wherein the rotation for nondetection comprises at least one of:

rotation of the conveyor member while forming the print image on the image recording medium, wherein the forming the print image on the image recording medium comprises one of:

printing the print image on the image recording medium, and printing the print image on the conveyor member and transferring the print image from the conveyor member to the image recording medium;

rotation of the conveyor member to clean the conveyor member by rotating the conveyor member while a cleaning device cleans the conveyor member; and rotation of the conveyor member to prevent loosening of the conveyor member by rotating the conveyor member for a predetermined time period after printing of the print image on the image recording medium, wherein the step of obtaining the amount of reflected light received by the optical sensor and adjusting the value of sensitivity for the optical sensor further comprises using a conveyance area to determine an amount of adjustment for the value of the sensitivity for the optical sensor by using an amount of the received light reflected at least from a portion of the conveyance area, when at least one of a plurality of criteria is met, wherein the at least one of the plurality of criteria is selected from the group consisting of:

a length of the image recording medium in a rotating direction of the conveyor member is greater than or equal to a predetermined reference length, and a width of the image recording medium in a direction orthogonal to the rotating direction is greater than or equal to a predetermined reference width, and wherein the conveyance area is a portion of a surface of the conveyor member and is equivalent in size to an image recording medium area.

13. The method for controlling an image forming apparatus according to claim 12, wherein the rotation for nondetection comprises the rotation of the conveyor member to clean the conveyor member by rotating the conveyor member while the cleaning device cleans the conveyor member.

14. The method for controlling an image forming apparatus according to claim 12, wherein the rotation for nondetection comprises the rotation of the conveyor member to prevent loosening of the conveyor member by rotating the conveyor member for a predetermined time period after printing of the print image on the image recording medium.

15. An image forming apparatus comprising:

a conveyor member configured to rotate;

an optical sensor comprising:

a light emitting portion configured to irradiate the conveyor member with light; and a light receiving portion configured to receive reflected light that is reflected from the conveyor member;

an image forming portion configured:

to form a print image onto the conveyor member; and to form a mark for correction onto the conveyor member when the optical sensor performs a mark detection;

a drive portion that configured to perform:

a rotation for detection, wherein the drive portion is configured to rotate the conveyor member while the optical sensor performs the mark detection; and a rotation for nondetection, wherein the drive portion is configured to rotate the conveyor member while the conveyor member performs another function distinct from the mark detection; and a controller configured:

to obtain an amount of reflected light received by the optical sensor, while the rotation for nondetection is performed;

to adjust a value of sensitivity for the optical sensor based on the amount of reflected light received by the optical sensor; and to detect the mark with the optical sensor with the adjusted value of sensitivity while the rotation for detection is performed, wherein the conveyor member is a medium conveyor member configured to convey the image recording medium during the forming of the print image on the image recording medium by the image forming portion, wherein the rotation for nondetection comprises at least one of:

rotation of the conveyor member while forming the print image on the image recording medium, wherein the forming the print image on the image recording medium comprises one of:

printing the print image on the image recording medium, and printing the print image on the conveyor member and transferring the print image from the conveyor member to the image recording medium;

rotation of the conveyor member to clean the conveyor member by rotating the conveyor member while a cleaning device cleans the conveyor member; and rotation of the conveyor member to prevent loosening of the conveyor member by rotating the conveyor member for a predetermined time period after printing of the print image on the image recording medium, wherein the controller is configured to use a conveyance area to determine an amount of adjustment for the value of the sensitivity for the optical sensor by using an amount of the received light reflected at least from a portion of the conveyance area, when at least one of a plurality of criteria is met, wherein the at least one of the plurality of criteria is selected from the group consisting of:

a length of the image recording medium in a rotating direction of the conveyor member is greater than or equal to a predetermined reference length, and a width of the image recording medium in a direction orthogonal to the rotating direction is greater than or equal to a predetermined reference width, and wherein the conveyance area is a portion of a surface of the conveyor member and is equivalent in size to an image recording medium area.

16. The image forming apparatus according to claim 15, wherein the rotation for nondetection comprises the rotation of the conveyor member to clean the conveyor member by rotating the conveyor member while the cleaning device cleans the conveyor member.

17. The image forming apparatus according to claim 15, wherein the rotation for nondetection comprises the rotation of the conveyor member to prevent loosening of the conveyor member by rotating the conveyor member for a predetermined time period after printing of at least one of the print image and the other print image.

18. The image forming apparatus according to claim 15, wherein the controller is configured to obtain the amount of reflected light received by the optical sensor a predetermined number of times to determine the amount of adjustment for the value of the sensitivity for the optical sensor; and wherein, when the controller does not obtain the amount of reflected light received by the optical sensor the predetermined number of times while the drive portion performs the rotation for nondetection, the drive portion is configured to continue to rotate the conveyor member until the amount of reflected light received by the optical sensor has been obtained the predetermined number of times.

19. The image forming apparatus according to claim 15, wherein the controller is configured to sample the amount of the reflected light received by the optical sensor a predetermined number of times during a predetermined time period to determine the amount of adjustment for the value of the sensitivity for the optical sensor; and wherein, when the controller does not sample the amount of the reflected light received by the optical sensor the predetermined number of times while the drive portion performs the rotation for nondetection during the predetermined time period, the drive portion is configured to continue to rotate the conveyor member until the controller has sampled the amount of the reflected light received by the optical sensor the predetermined number of times.

20. An image forming apparatus comprising:

a conveyor member configured to rotate;

an optical sensor comprising:

a light emitting portion configured to emit light toward the conveyor member; and a light receiving portion configured to receive reflected light that is reflected from the conveyor member;

an image forming portion configured:

to form a print image onto an image recording medium; and to form a mark onto one or more of the conveyor member and the image recording medium when the optical sensor performs a mark detection;

a drive portion configured to perform:

a rotation for detection, wherein the drive portion is configured to rotate the conveyor member while the optical sensor performs the mark detection; and a rotation for nondetection, wherein the drive portion is configured to rotate the conveyor member while the conveyor member performs another function distinct from the mark detection; and a controller configured:

to obtain an amount of reflected light received by the optical sensor, while the rotation for nondetection is performed;

to adjust a value of sensitivity for the optical sensor based on the amount of reflected light received by the optical sensor; and to detect the mark with the optical sensor with the adjusted value of sensitivity while the rotation for detection is performed, wherein the conveyor member is a medium conveyor member configured to convey the image recording medium during the forming of the print image on the image recording medium by the image forming portion, wherein the rotation for nondetection comprises rotation of the conveyor member while forming the print image on the image recording medium, wherein the forming the print image on the image recording medium comprises one of:

printing the print image on the image recording medium, and printing the print image on the conveyor member and transferring the print image from the conveyor member to the image recording medium, wherein the controller is configured to use a conveyance area of the conveyor member to determine an amount of adjustment for the value of the sensitivity for the optical sensor by using an amount of the received light reflected at least from a portion of the conveyance area, and wherein the conveyance area is a portion of a surface of the conveyor member and is equivalent in size to an image recording medium area.

* * * * *